United States Patent [19]

Lee

[11] Patent Number: 4,738,314

[45] Date of Patent: Apr. 19, 1988

[54] ULTRA FAST FUSIBLE LINK ASSEMBLY WITH MECHANICAL ADVANTAGE

[75] Inventor: John T. M. Lee, Phoenixville, Pa.

[73] Assignee: ICI Americas Inc., Wilmington, Del.

[21] Appl. No.: 927,142

[22] Filed: Nov. 5, 1986

[51] Int. Cl.[4] ..... A62C 37/30

[52] U.S. Cl. ..... 169/42; 169/19

[58] Field of Search ..... 169/42, 38, 39, 57, 169/19; 137/72

[56] References Cited

U.S. PATENT DOCUMENTS 1,021,329 3/1912 Poppendieck ..... 169/42

2,324,428 7/1943 Roessner ..... 169/42

2,526,159 10/1950 Rowley ..... 169/38

2,730,900 1/1956 Rowley ..... 169/42 X

*Primary Examiner*—Joseph F. Peters, Jr.

*Assistant Examiner*—James M. Kannofsky

[57] ABSTRACT

An ultra fast fusible link assembly with mechanical advantage is provided for controlling the release of loaded devices used in automatic fire fighting equipment wherein the assembly comprises a pair of interlocked mechanical members supporting the load and held together by a fusible link with sufficiently energy thereby when said link is broken said mechanical members fly apart to release said load.

1 Claim, 1 Drawing Sheet

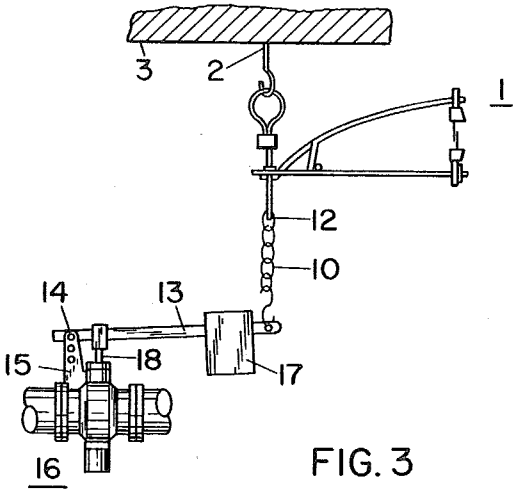
FIG. 3
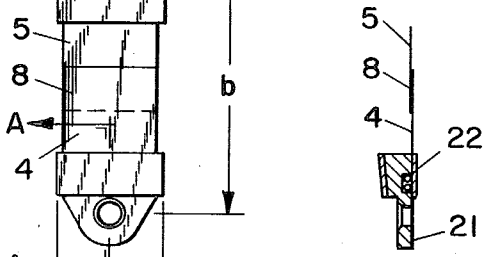
FIG. 2a
FIG. 2
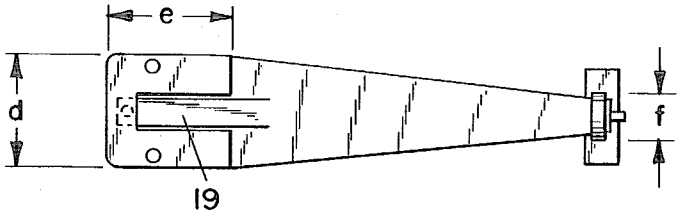
FIG. 1c
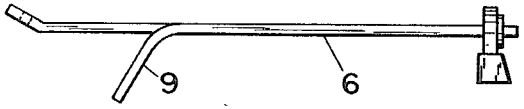
FIG. 1b
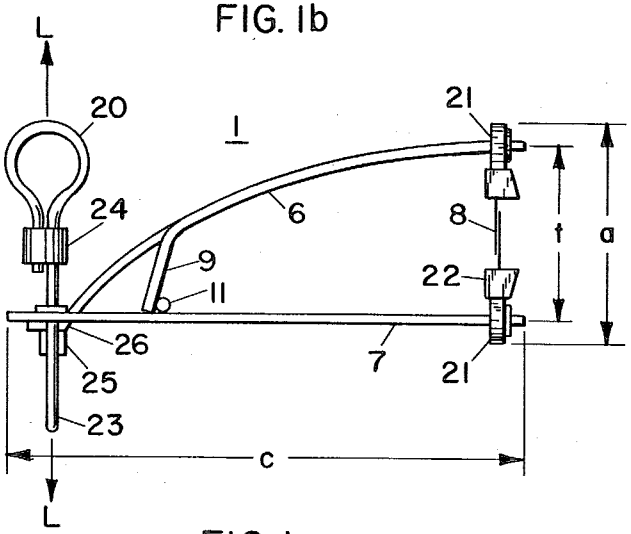
FIG. 1
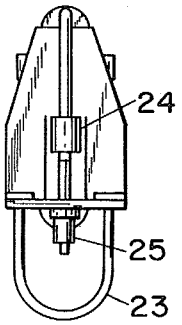
FIG. 1a

ULTRA FAST FUSIBLE LINK ASSEMBLY WITH MECHANICAL ADVANTAGE

This invention is directed to a fusible element adapted for use in connection with efficient, fool-proof and reproducible thermally responsive devices for supporting loads. The fusible link provides for the release of the load automatically at predetermined elevated temperatures within a predetermined time. In particular the invention is directed to fusible links made by joining overlapping thin metal strips with a thin layer of fusible material to form a lap joint having a surface-to-volume ratio of at least 100 $inch^{-1}$. Specifically the invention is directed to an assembly of interlocking load support members which are held together by tension provided by a thermally responsive fusible link. The interlocking members are so constructed that when they are pulled together by the insertion of the fusible link they are held together with sufficient tension and elastic energy that they fly apart when the fusible link is broken even though the device is not installed to support a load.

In my recently issued U.S. Pat. No. 4,577,544 I have described an improved automatic sprinkler system employing an improved fusible link actuator incorporating a thermally responsive tension member having a pair of overlapping thin strips joined together by a thin layer of fusible material. The fusible link of the present invention has all the improvements offered by my previous invention in addition to an extended reproducible life.

It has been found that fusible link elements which are used to support loads in various devices and in particular in automatic fire fighting equipment encounter load and stress variations due to changes in temperature, building vibrations and load fluctuations such as varying water pressure have a tendency to cause deterioration in the overlap joint constructed of thin metal strips held together with solder or an adhesive.

Deterioration of the fusible link due to variations in load, vibration and the like are substantially reduced by preloading the fusible link in excess of that caused by variations in the support load due to vibrations, shock loads and other fluctuations.

It is the object of the invention to provide a heat responsive device which is accurate and quick in its response when placed under tension with varying loads. A particular object of the invention is to provide an overlapped fusible link formed by joining two flat sheets of metal together which are fixed at each end to intermediate deformable tension members which when interlocked provide a support for a variable load. The bending forces applied to the members upon assembly is sufficient to compensate for the variations in load which would otherwise be transferred directly to the thin metal fusible link.

These and other objects of the invention are provided by a thermally responsive ultra-fast fusible link assembly used for releasing loaded devices in automatic fire protection equipment said assembly comprising;

(a) a thermosensitive fusible link comprising a pair of overlapping thin strips joined together by a thin layer of fusible material, (b) an interlocking pair of mechanical members held together in compression by said thermosensitive fusible link, (c) a means connected to each mechanical member to support a load, wherein the bending forces used to hold the mechanical members together is sufficient to substantially overcome variations in load transmitted to said fusible link and which provides sufficient spring energy to permit said mechanical members to fly apart when said fusible link is broken.

The invention can be better understood by referring to the attached drawings:

FIG. 1 is a side view of an assembled linkage made in accordance with the invention;

FIG. 1*a* is an end view of FIG. 1 assembly;

FIG. 1*b* is a side view of a nondeformed component support member;

FIG. 1*c* is the top view of FIG. 1 assembly.

FIG. 2 is a fusible link assembly; and

FIG. 2*a* is a sectional view along the line A—A of FIG. 2.

FIG. 3 is a side elevational view showing a practical application of the ultrafast fusible link assembly.

The advantages offered by the invention are demonstrated in its practical application by reference to FIG. 3 wherein the Assembly of the invention (1) is held under variable load conditions to a hook (2) which is screwed into a support structure (3). The device is connected through a link (12) through a chain (10) to the outer end of a lever (13) carrying an adjustable weight (17) and at a point relatively close to the pivot (14) the lever (13) supports a valve stem (18) and a valve in the casing (16) which is connected to said stem.

When the linkage of the invention is in operation as illustrated lever (13) is held in an elevated position and the valve is open. If by reason of elevated temperature the link (8) (shown in detail in FIG. 1) melts and is broken the spring loaded member (6) will be forced away from support member (7) enabling side feet (9) to spring loose thus permitting top support member to pull away at slot (26) enabling the device to separate and release load (L). The non-deformed released top member component in non-deformed confirmation is shown by FIG. 1*b*. This will thereby permit the lever (13) under action of the weight (17) to move downwardly about pivot (14) and thereby close the valve. The assembly (1) may take a variety of forms of which one is illustrated by FIGS. 1 and 2. The fusible or thermosensitive link comprises basic components such as two separable plates (4) and (5) overlapped and held together by a fusible material spread over a predetermined surface area at (8). The fusible material may be made of thermoplastic resins, glues or metallic solder all of which have a predetermined fusion point. The thermal link is placed in tension at each end in the device (1) which responds to the release of the tension or load held in check by the fusible link.

The metal sheets (4) and (5) are thermally insulated at their junction with upper and lower assembly members (21) and (22). With reference to FIG. 2*a* junction piece (21) is held in place by overlapping insulation piece (22) which may be manufactured from thermoplastic materials made from such plastics as polyurethanes, phenylformaldehyde, fluorinated resins, ceramics, mineral filled papers and glass.

It is important for the lap joint (8) to have a low mass and high surface-to-volume ratio in order to insure rapid response once the predetermined melting temperature of the fusible material has been reached. Both low mass and high surface-to-volume ratio are achieved by making strips (4) and (5) and layer of fusible material as thin as possible. Control and design of this feature is taught in Column 5 of my U.S. Pat No. 4,577,544 and is hereby incorporated by reference.

The overlap sheets or plates may be of such thickness and size required to provide bending forces on the members of the assembly (6) and (7). Such tension required is usually only a fraction of that tension provided by the Load because of the mechanical advantage offered by the device. The compressive tension (T) placed on the device is adjusted by regulating a distance (a) and (b) of the fusible linkage assembly. The overlapping sheet or plates may be of such thickness and size required to support the load in order to hold the device in a passive mode. The ratio of bending tension (T) to that of the Load (L) may range from 0.01L–0.8L. The sheets or plates used to manufacture the fusible element may be made of copper, brass, stainless steel, and in some instances, gold, platinum or silver depending upon the corrosive nature of the atmosphere. In general the thinner the strip the more responsive the fusible material is to the surrounding atmospheric temperature. Usually stainless steel type 304 having a width of from 5–20 mm and a thickness of 0.025–0.25 mm is preferred. The construction and design of the assembly may vary. The following example is offered to serve as one illustration for carrying out the invention which is considered to be non-limiting with regard to the inventive features.

EXAMPLE 1

With reference to the figures a bottom support member (7) is constructed from 0.06 inch thick stainless steel having the following dimensions; (c)=3.4 inch, (d) and (e)=0.75 inch, (f)=0.25 inch. A stop bar is welded to the surface at (11) and a slot is cut at (26) for transverse insertion of center tongue (19) of top member (6) having overall dimensions as previously listed and with center tongue and side feet widths of 0.25 inch. The top member is also made from 0.06 inch stainless steel. Wire loop (20) is constructed of 0.06 inch braided steel cable with crimp sleeves (24) and (25). Loop (23) is made of 0.06 inch solid wire placed through coals in the bottom member and swaged.

The fusible link assembly of FIG. 2 is constructed of 0.001 inch thick stainless having dimension (g) of 0.5 inches (b) of 1.5 inches. The end assemblies (21) and (22) are constructed from polyetheretherketone resin.

The side feet (9) are bent such that when the center tongue of top member (6) is inserted in slot (18) and bent to dimension (a), a mechanical advantage in excess of 30 to 1 is achieved and if the assembly is preloaded to support a 20 pound external Load is has been found that varying loads of plus or minus 20 pounds will not cause a change in the tension load (T) to vary. The operating characteristics of the fusible link at (8) is maintained for an unlimited period at the time.

What is claimed is:

1. A thermally responsive ultra-fast fusible link assembly used for releasing loaded devices in automatic fire protection equipment said assembly comprising;

(a) a thermosensitive fusible link comprising a pair of overlapping thin strips joined together by a thin layer of fusible material, (b) an interlocking pair of mechanical members held together in compression by said thermosensitive fusible link, (c) a means connected to each mechanical member to support a load, wherein the bending forces used to hold the mechanical members together is sufficient to substantially overcome variations in load transmitted to said fusible link and which provides sufficient spring energy to permit said mechanical members to fly apart when said fusible link is broken.

* * * * *